United States Patent [19]

Evenson

[11] Patent Number: 4,613,290

[45] Date of Patent: Sep. 23, 1986

[54] EVACUATED PUMPING SYSTEM

[75] Inventor: William R. Evenson, South Houston, Tex.

[73] Assignee: Lefco Western, Inc., Houston, Tex.

[21] Appl. No.: 602,927

[22] Filed: Apr. 23, 1984

[51] Int. Cl.[4] ..... F04B 15/02; F04B 7/00

[52] U.S. Cl. ..... 417/517; 417/519; 417/532; 417/900

[58] Field of Search ..... 417/519, 532, 517, 516, 417/900, 199 A, 199 R, 200, 148, 129

[56] References Cited

U.S. PATENT DOCUMENTS

| | | | |
|---|---|---|---|
| 547,538 | 10/1895 | Coffey | 417/900 |
| 1,940,007 | 12/1933 | Moore | 417/199 A |
| 2,071,703 | 2/1937 | Nelson et al. | 417/200 |
| 3,749,522 | 7/1973 | Kazama et al. | 417/900 |
| 4,057,364 | 11/1977 | Bratschitsch | 417/129 |
| 4,198,193 | 4/1980 | Westerlund et al. | 417/519 |
| 4,337,017 | 6/1982 | Evenson | 417/516 |

FOREIGN PATENT DOCUMENTS

| | | | |
|---|---|---|---|
| 8001594 | 8/1980 | Fed. Rep. of Germany | 417/516 |

*Primary Examiner*—Cornelius J. Husar
*Assistant Examiner*—Peter M. Cuomo
*Attorney, Agent, or Firm*—B. P. Fishburne, Jr.

[57] ABSTRACT

A pumping system for various flowables utilizes a dual alternating piston pump in communication with a tank hopper having flowable material inlet and delivery lines and an internal oscillating elbow conduit equipped with a pressurized wear plate which is moved cyclically into and out of registration with the cylinders of the dual alternating piston pump. A vacuum pipe rising from the tank hopper having a floating check valve and a suction shut off valve communicates with a vacuum pump external to the tank hopper through a filter. The evacuated tank hopper is enabled to fill itself immediately with flowable material and maintain a full condition while the dual alternating piston pump is pumping material through the delivery line with high efficiency. When vacuum to the tank hopper is shut off, the dual piston pump can be reversed to pump through the suction line while drawing in material through the delivery line.

1 Claim, 4 Drawing Figures

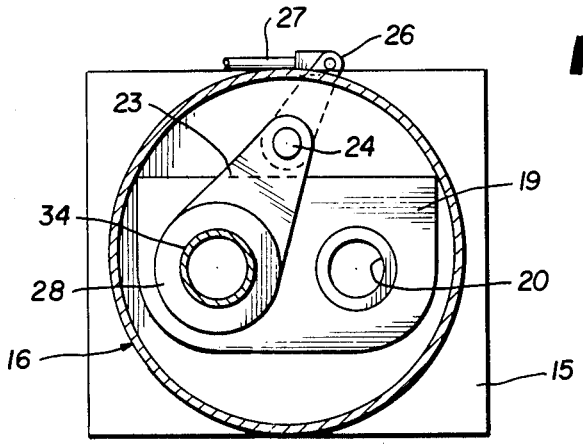
FIG. 3
FIG. 4
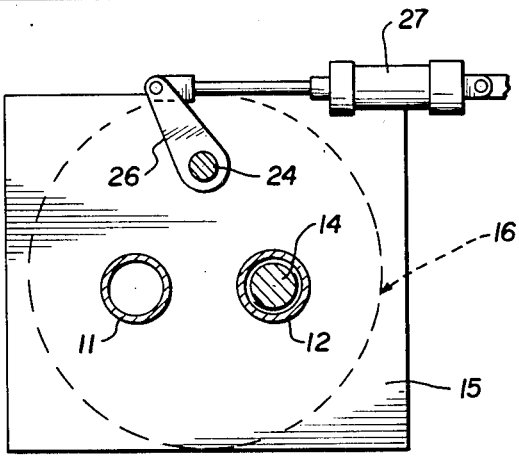
FIG. 2
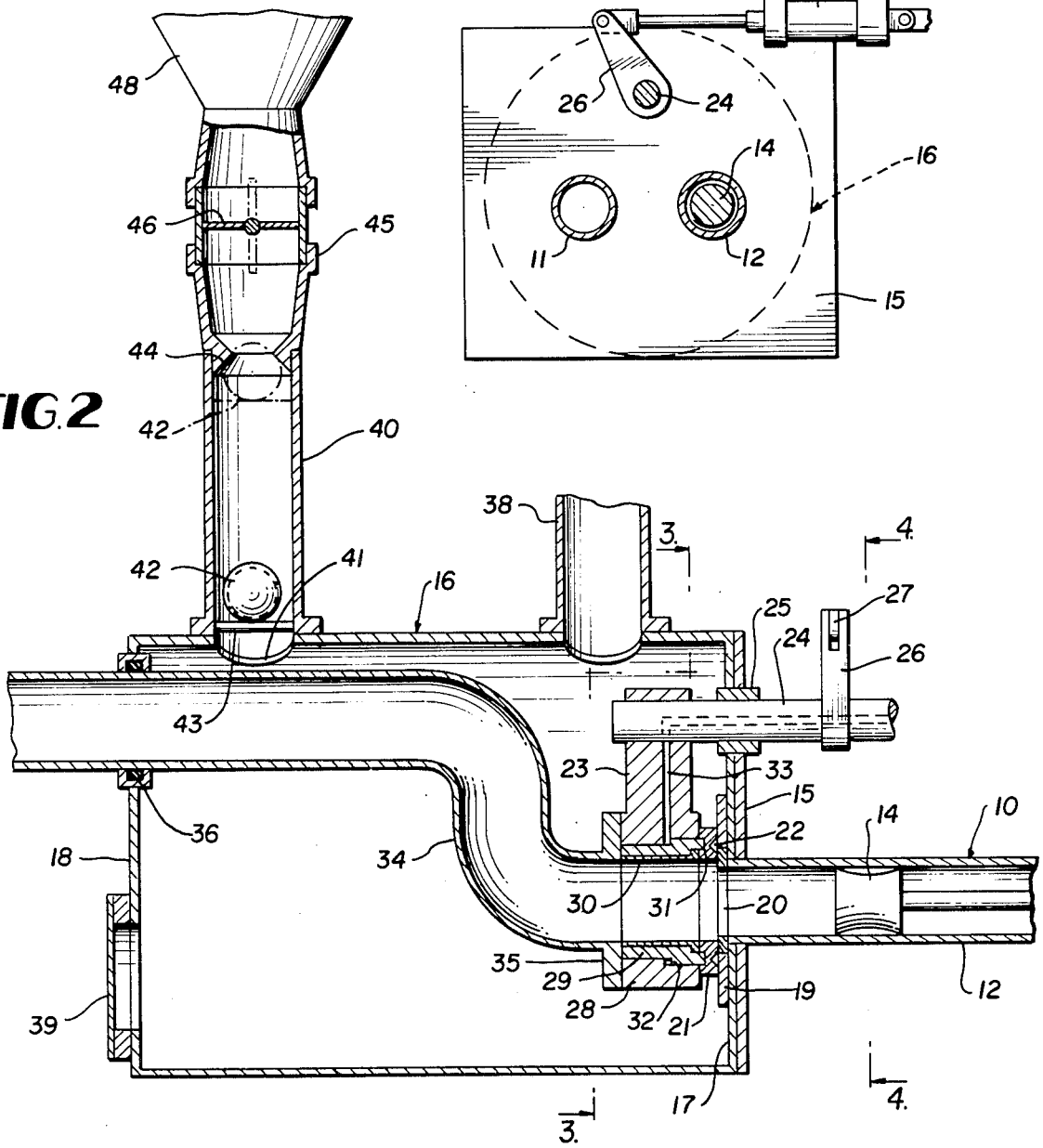

EVACUATED PUMPING SYSTEM

BACKGROUND OF THE INVENTION

An object of the present invention is to imorove on the efficiency and versatility of operation of pumping systems of the type disclosed in U.S. Pat. No. 4,337,017. Such prior art pumping systems having hoppers for flowable materials which are open to the atmosphere are dependent upon external material filling means and if the hopper is not maintained filled to an adequate level, the pumping system becomes sluggish and inefficient. Also, widely varying consistencies of flowables being pumped are reflected by the changing ability of the dual piston pump to keep up with demand for the pumped material because its operation is affected by changes in material consistency. The dual piston pump can pump with greater efficiency materials of certain thickness and will pump with lesser efficiency materials of different thicknesses.

In accordance with the present invention, the dual alternating piston pump is employed in conjunction with a closed tank hopper in which a substantial partial vacuum is maintained through a vacuum pipe leading from the tank hopper and in communcation with an external vacuum pump. Flowable material from any convenient source is sucked into the tank hopper through a suction line and is pumped out through a material delivery line by the operation of the dual piston pump. Suction created by the dual piston pump is not relied on to fill the tank hopper although it does have a suction boosting effect. Since the evacuated tank hopper can fill itself quickly and maintain a full state during the operation of the dual piston pump, the efficiency of that pump and the overall efficiency of the pumping system is greatly enhanced by the invention.

A further feature of the present invention enables quickly shutting off the vacuum source connected with the tank hopper to allow reversing of the operation of the dual piston pump, whereby material can be drawn into the pump through its delivery line and pumped out through the inlet or suction line. A floating check valve in the rising vacuum pipe prevents material in the tank hopper from being sucked into the vacuum pump and damaging it, and a filter unit connected between the vacuum pipe and vacuum pump further precludes this possibility.

Other features and advantages of the invention will become apparent to those skilled in the art during the course of the following detailed description.

BRIEF DESCRIPTION OF THE DRAWINGS

FIG. 2 is a fragmentary central vertical section through the system.

FIG. 3 is a vertical section taken on line 3—3 of FIG. 2.

FIG. 4 is a vertical section taken on line 4—4 of FIG. 2.

DETAILED DESCRIPTION

Figure 1:
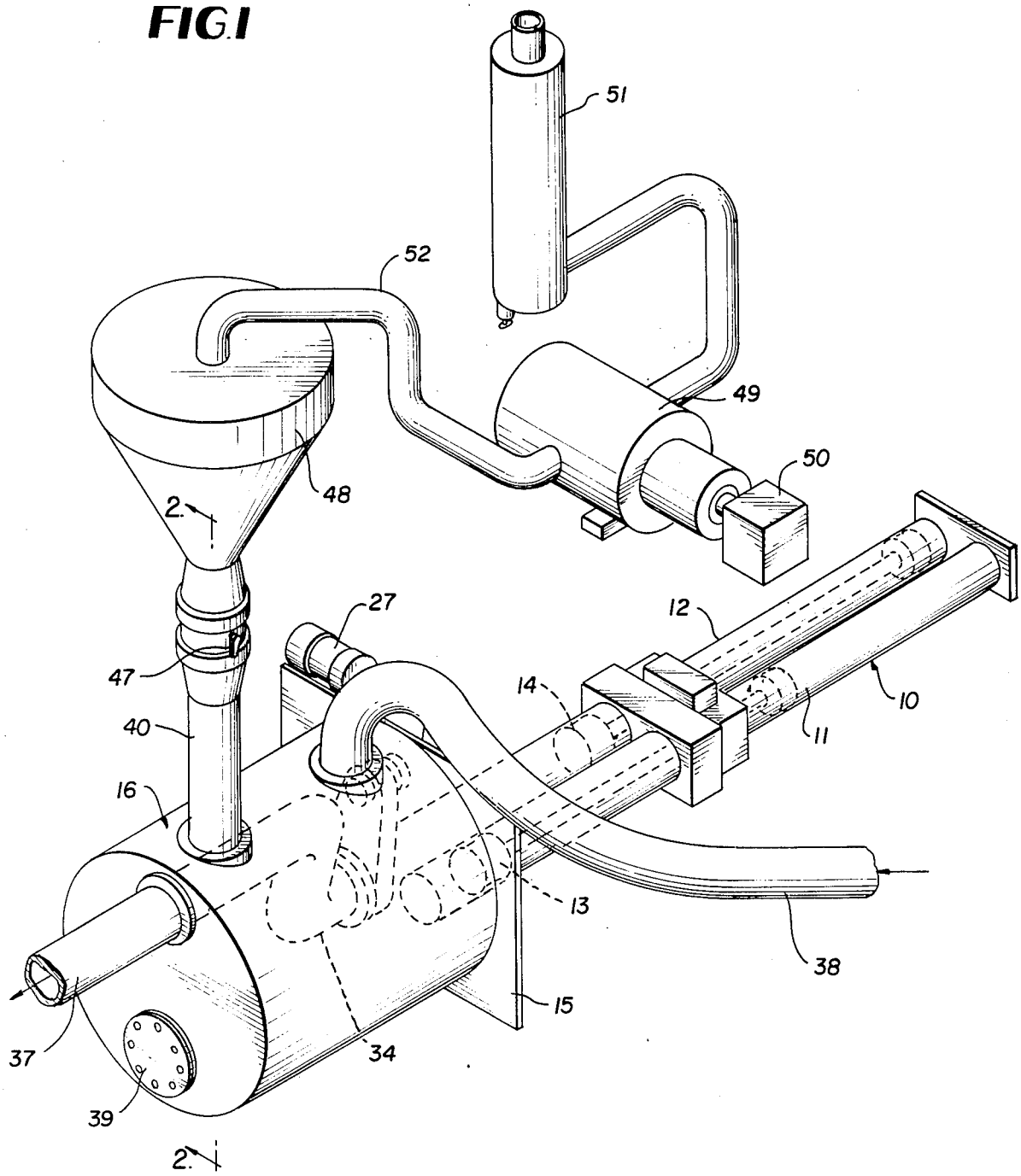
FIG. 1 is a perspective view of an evacuated pumping system for flowables according to the invention.

Referring to the drawings in detail wherein like numerals designate like parts, a pumping system for viscous materials, such as concrete, industrial sludge, sewage and the like, comprises a dual alternating piston pump 10 of the type shown in U.S. Pat. No. 4,337,017. The pump 10 comprises two parallel axis cylinders 11 and 12 containing alternating pistons 13 and 14 within the bores of the two cylinders. The forward open ends of the cylinders 11 and 12 are fixed secured through openings of a strong backing plate 15 of a tank hopper 16 having a back wall 17 and a front wall 18, the tank hopper being cylindrical, as shown, or any other convenient shape. The forward ends of the two cylinders 11 and 12 are also received in openings formed in the tank hopper back wall 17.

A stationary wear plate 19 on the back wall 17 having openings 20 in registration with the bores of the two cylinders 11 and 12 is interfaced with a sliding wear ring 21 having a ring seal 22 adapted for wiping contact with the opposing face of wear plate 19.

A crank arm 23 disposed within the tank hopper 16 is secured to a rotational shaft 24 held in a bearing 25 of the tank hopper 16. At proper times, the shaft 24 is turned by a crank 26 fixed thereon, in turn being operatively connected to a power cylinder 27 as shown in said prior patent.

The crank arm 23 includes a hub portion 28 within which is held an axially displaceable sleeve 29 having a replaceable liner 30 therein whose bore registers with the bore of the wear ring 21. One end of the sleeve 29 is seated in an annular groove 31 of the wear ring 21 to form an interlocking connection therewith.

The displaceable sleeve 29 has an exterior annular shoulder 32 against which pressurized hydraulic fluid is delivered through a port 33 in the crank arm 23 and rotational shaft 24 from a suitable remote source. The resulting fluid pressure acting on the annular shoulder 32 forces the displaceable sleeve 29 and the wear ring 21 into sealing engagement with the stationary wear plate 19, as described in said prior patent.

An oscillating elbow conduit 34 within the tank hopper 16 has a flange 35 thereof coupled to the opposing face of the hub 28 of swinging crank arm 23. The opposite end of the elbow conduit 34 is rotatably held within a seal 36 on the front wall 18 of the tank hopper. The elbow conduit 34 leads to and is connected with a material discharge and delivery conduit 37, or line, extending outside of the tank hopper 16 to any remote use site or storage point for the pumped material.

A separate inlet or suction line 38 for pumped material is connected preferably into the top of the tank hopper 16 and extends to a convenient source of the flowable material being pumped, such as a storage tank. The tank hopper 16 is further equipped with a clean-out port 39, as shown.

A vacuum pipe 40 rises vertically from the tank hopper 16 and communicates therewith through an opening 41. A preferably stainless steel hollow ball check valve element 42 is disposed loosely and floatingly in the vacuum pipe 40 and is prevented from falling into the tank hopper 16 by a fixed cross pin 43 at the bottom of the pipe 40. A conical seat 44 for the ball valve element 42 is provided at the top of vacuum pipe 40, so that when the ball floats upwardly through the pipe 40 on the material rising from the tank hopper it will engage the seat 44 and form a check valve to stop the upward flow of material in the vacuum pipe 40.

Above the valve seat 44, a housing 45 mounted on the pipe 40 contains a manual vacuum shut-off valve 46, preferably in the form of a butterfly valve, having an external operator 47, FIG. 1. Above this shut-off valve is a conventional screen filter 48 to prevent any solid material which might escape through the seat 44 from reaching a vacuum pump 49 and causing damage to the same. This vacuum pump, which maintains a substantial degree of vacuum in the tank hopper 16, is driven by a hydraulic motor 50 or by other suitable means. The pump 49 is silenced during operation by an exhaust muffler 51. The suction side of the vacuum pump 49 is connected by a vacuum line 52 with the filter 48. Preferably, the pump 49 has a volumetric capacity of about 400 CFM and has the ability to maintain constantly within the tank hopper 16 a partial vacuum of about 29 inches Hg.

OPERATION

The suction line 38 is connected to a source of flowable material requiring pumping, and the material delivery line 37 is extended to an appropriate point of consumption or storage for the pumped material. The butterfly valve 46 is opened and both the vacuum pump 49 and dual piston pump 10 are set into operation.

The resulting vacuum quickly developed and maintained in the tank hopper 16 causes the tank hopper to fill itself quickly with material and maintain itself full during the operation of the system. Suction developed by the dual piston pump 10 is not relied upon to produce a vacuum in the tank hopper and the full power of the piston pump is utilized to expel the flowable material from the tank hopper 16 via the delivery line 37, as described in the prior patent. Because of the relatively high vacuum being maintained in the tank hopper by the pump 49, the dual piston pump 10 can operate with much greater efficiency than would be the case if it were being relied upon also to pull a vacuum in the tank hopper 16.

The ball valve element 42 is not elevated against the seat 44 as long as the pump 49 is merely pulling air out of the tank hopper 16. However, when the tank hopper fills itself with the flowable material to be pumped and such material begins to rise in the vacuum pipe 40, the ball 42 floats on and is lifted by the material until it seats itself against the seat 44, thus preventing the flowable material from entering the screen filter 48 and ultimately reaching the vacuum pump 49.

Should any flowable material get by the ball check valve arrangement, the screen filter 48, acting as a secondary blocking element, will prevent the material from reaching the vacuum pump 49 and damaging it.

The overall pumping efficiency of the system, speed of pumping, and therefore the pumping capacity, is greatly enhanced by the use of the vacuum pump 49 in conjunction with the dual alternating piston pump 10 on the closed tank hopper 16.

If the vacuum shut-off valve 46 is closed, the pumping system is rendered reversible, thus increasing its versatility. As described in the prior patent, the piston pump 10 is operated in reverse of its usual cycle and sucks material into the tank hopper 16 through the usual discharge line 37 and pumps the material out through what is normally the inlet suction line 38. In this operating mode, the suction generated by the piston pump 10 is relied upon to create the necessary vacuum in the system and the resulting operation is less efficient than when the vacuum pump 49 is being utilized.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A pumping system for viscous flowables comprising a closed tank hopper, an inlet suction line for viscous flowables connected into the top of the closed tank hopper and extending to a supply of a viscous flowable, a delivery line for viscous flowables connected into the closed tank hopper and extending therefrom to a point of consumption or storage for viscous flowables, an oscillatable elbow disposed within the closed tank hopper and being connected with said delivery line, a dual cylinder alternating piston pump connected with one wall of the closed tank hopper and having its cylinder bores in communication with the interior of the closed tank hopper, power means connected with said oscillatable elbow to swing the same into alternating registration with the cylinder bores of the dual cylinder alternating piston pump, a vacuum pump separate from and operating independently of the dual cylinder alternating piston pump and disposed exteriorly of the closed tank hopper, and a vacuum conduit means connected between the top of the closed tank hopper and said vacuum pump and including a vertical pipe section rising from the top of the closed tank hopper, a floatable one-way active check valve element within the vertical pipe section and being engageable with a valve seat therein to block the passage of viscous flowables in the closed tank hopper to the vacuum pump, a vacuum shut-off valve in the vertical pipe section, and a filter means in said vacuum conduit means.

* * * * *